US006876337B2

(12) United States Patent
Larry

(10) Patent No.: US 6,876,337 B2
(45) Date of Patent: Apr. 5, 2005

(54) SMALL CONTROLLED PARASITIC ANTENNA SYSTEM AND METHOD FOR CONTROLLING SAME TO OPTIMALLY IMPROVE SIGNAL QUALITY

(75) Inventor: Thomas Larry, Goleta, CA (US)

(73) Assignee: Toyon Research Corporation, Goleta, CA (US)

( * ) Notice: Subject to any disclaimer, the term of this patent is extended or adjusted under 35 U.S.C. 154(b) by 0 days.

(21) Appl. No.: 10/206,101

(22) Filed: Jul. 29, 2002

(65) Prior Publication Data

US 2003/0030594 A1 Feb. 13, 2003

Related U.S. Application Data

(60) Provisional application No. 60/308,097, filed on Jul. 30, 2001.

(51) Int. Cl.[7] ..... H01Q 21/08

(52) U.S. Cl. ..... 343/818; 343/820; 343/822

(58) Field of Search ..... 343/818, 820, 343/822, 793, 816, 850, 853, 860, 834, 836, 837

(56) References Cited

U.S. PATENT DOCUMENTS

| | | | | |
|---|---|---|---|---|
| 3,218,645 | A | 11/1965 | Ehrenspeck | |
| 3,560,978 | A | 2/1971 | Himmel et al. | |
| 3,656,167 | A * | 4/1972 | Lea | 343/793 |
| 3,846,799 | A | 11/1974 | Gueguen | |
| 3,877,014 | A | 4/1975 | Mailloux | |
| 3,950,753 | A | 4/1976 | Chisholm | |
| 3,996,592 | A | 12/1976 | Kline et al. | |
| 4,260,994 | A | 4/1981 | Parker | |
| 4,387,378 | A | 6/1983 | Henderson | |
| H26 | H | 2/1986 | Dinger | |
| 4,631,546 | A | 12/1986 | Dumas et al. | |
| 4,700,197 | A | 10/1987 | Milne | |

(Continued)

OTHER PUBLICATIONS

Dinger, "A Planar Version of a 4.0 GHz Reactively Steered Adaptive Array," IEEE Transactions on Antennas and Propagation, vol. AP–34, No. 3 (Mar. 1986), pp. 427–431.

Nakano et al., "Axial Mode Helical Antennas," IEEE Transactions on Antennas and Propagation, vol. AP–34, No. 9 (Sep. 1986), pp. 1143–1148.

Nakano, et al., "Axial Mode Helical Antennas, " IEEE Transactions on Antennas and Propagation, vol. AP–34, No. 9 (Sept. 1986), pp. 1143–1148.

Nakano, Hisamatsu, Ct al., "Realization of Dual–Frequency and Wide–Band VSWR Performances Using Normal–Mode Helical and Inverted–F Antennas, " IEEE Transactions on *Antennas and Propagation,* vol. 46, No. 6, pp. 788–793, Jun. 1998.

(Continued)

*Primary Examiner*—James Vannucci
(74) *Attorney, Agent, or Firm*—Nixon & Vanderhye P.C.

(57) ABSTRACT

The invention relates to a small (0.5 wavelength or less) adaptable antenna system. In particular it relates to the use of loaded parasitic components in the antenna aperture for the purpose of controlling the RF properties of the antenna. Such an antenna system is here referred to as a controlled parasitic antenna (CPA). Parasitic elements within the radiating aperture are terminated by active (controllable) impedance devices. A feedback and control subsystem periodically adjusts the impedance characteristics of these devices based on some observed metric of the received waveform. Such antenna systems can provide multifunctionality within a single aperture and/or mitigate problems associated with the reception of an interfering signal (or signals) or multi-path effects. Such antenna systems are particularly suitable to a situation where an aperture size is desired that is too small for the use of an adaptive phased array.

28 Claims, 8 Drawing Sheets

U.S. PATENT DOCUMENTS

| | | | | |
|---|---|---|---|---|
| 5,235,343 | A | 8/1993 | Audren et al. | |
| 5,293,172 | A | 3/1994 | Lamberty et al. | |
| 5,294,939 | A | 3/1994 | Sanford et al. | 343/836 |
| 5,767,807 | A | 6/1998 | Pritchett | |
| 5,905,473 | A | 5/1999 | Taenzer | |
| 5,923,305 | A | 7/1999 | Sadler et al. | |
| 6,034,638 | A | 3/2000 | Thiel et al. | |
| 6,040,803 | A | 3/2000 | Spall | |
| 6,122,260 | A | 9/2000 | Liu et al. | 370/280 |
| 6,133,882 | A | 10/2000 | La Fleur et al. | 343/700 MS |
| 6,137,785 | A | 10/2000 | Bar-Ness | 370/328 |
| 6,177,906 | B1 | 1/2001 | Petrus | 342/378 |
| 6,181,279 | B1 | 1/2001 | Van Hoozen | 343/700 MS |
| 6,198,943 | B1 | 3/2001 | Sadler et al. | 455/553 |
| 6,229,486 | B1 | 5/2001 | Krile | 343/700 MS |
| 6,249,255 | B1 | 6/2001 | Eggleston | 343/702 |
| 6,252,548 | B1 | 6/2001 | Jeon | 342/383 |
| 6,285,327 | B1 | 9/2001 | See | 343/702 |
| 6,317,100 | B1 | 11/2001 | Elson et al. | 343/853 |
| 6,369,757 | B1 | 4/2002 | Song et al. | 342/378 |
| 6,407,719 | B1 | 6/2002 | Ohira et al. | |
| 6,448,937 | B1 | 9/2002 | Aiken et al. | |
| 6,492,942 | B1 | 12/2002 | Kezys | |
| 6,515,635 | B2 * | 2/2003 | Chiang et al. | 343/834 |
| 6,677,898 | B2 | 1/2004 | Cheng et al. | |
| 2003/0193446 | A1 | 10/2003 | Chen | |
| 2003/0210206 | A1 | 11/2003 | Phillips et al. | |
| 2004/0036651 | A1 | 2/2004 | Toda | |

OTHER PUBLICATIONS

Haviland, R.P., "Supergain Antennas: Possibilities and Problems, "*IEEE Antennas and Propagation Magazine,* vol. 37, No. 4, pp. 13–26, Aug. 1995.

Waterhouse, R.B., "The Use of Parasitic Elements to Remove Potential E–Plane Scan Blindness in High Dielectric Substrate Microstrip Patch–Fed Phased Arrrays, "*IEEE 0–7803–2009–May 1994,* pp. 456–459, 1994.

Ohira, Takashi, "Microwave Signal Processing and Devices for Adaptive Beamforming, "*IEEE 0–7803–6369–Aug. 2000,* 2000.

Ng, Kwong, T., et al., "Scan–Independent Slot Arrays with Parasitic Wire Arrays in a Stratified Medium, "*IEEE Transactions on Antennas and Propagation,* vol. 36, No. 4, pp. 483–495, Apr. 1988.

Herscovici, Naflali, "New Considerations in the Design of Microstrip Antennas, "*IEEE Transactions on Antennas and Propagation,* vol. 46, No. 6, pp. 807–8 Jun. 12, 1998.

Clavin, Alvin, et al., "An Improved Element for Use in Array Antennas, "*IEEE Transactions on Antennas and Propagation,* vol. AP–22, No. 4, pp. 52 1–526, Jul. 1974.

Mori, Kouhei, et al., "Active Antenna Using Parasitic Elements, "*IEEE 0–7803–4478–Feb. 1998,* pp. 1636–1639, 1998.

Dahale, J.S., et al., "Expermental Study of the Characteristics of Top–Loaded Microstrip Monopoles, "*IEEE Transactions on Antennas and Propagation,* vol. AP–3 1, No. 3 pp. 527–530, May 1983.

Sengupta, Dipak L., "Theory of Double Parasitic Loop Counterpoise Antenna Radiation Patterns, "*IEEE Transactions on Antennas and Propagation,* pp. 94–97, Jan. 1973.

Au, Tsien Ming, et al., "Effect of Parasitic Element on the Characteristics of Microstrip Antenna, "*IEEE Transactions on Antennas and Propagation,* vol. 39, No. 8, pp. 1247–1251, Aug. 1991.

Anguera, Jaume, "Miniature WideBand Stacked Microstrip Patch Antenna Based on the Sierpinski Fractal Geometry, "*IEEE 0–7803–6369–Aug. 2000,* 2000.

Sanad, Mohamed, "Non–Planar Shorted Double C–Patch Antennas for Portable Communication Equipment, "*IEEE 0–7803–3216–496,* pp. 738–741, 1996.

Sengupta, Dipak L., et al., "On the Radiation Patterns of Parasitic Loop Counterpoise Antennas, "*IEEE Transactions on Antennas and Propagation,* vol. AP–18, No. 1, pp. 34–41, Jan. 1970.

Obmine, Hiroyuki, et al., "An Annular–Ring Microstrip Antenna Fed by a Co–Planar Feed Circuit for Mobile Satellite Communication Use, "*IEEE Transactions on Antennas and Proagation,* vol. 45, No. 6 pp. 1001–1008, Jun. 1997.

Lee, R.Q., et al., "Enhancement of Array Gain with Stacked Parasitic Elements, "*IEEE 0–0 7803–2009–3/94,* pp. 468–471, 1994.

Liu, W.C., et al., "Optimized Shaped Parasitic Array Using the Genetic Algorithm, "*IEE Proc.–Microw. Antennas Propag.,* vol. 146, No. 5, pp. 339–341, Oct. 1999.

Ng, Kwong T., "Surface–Wave Phenomena in Phased Slot Arrays with Parasitic Wire Arrays, "*IEEE Transactions on Antennas and Propagation,* vol. 37, No. 11, pp. 1398–1406, Nov. 1989.

Pozar, David M., "Scanning Characteristics of Infinite Arrays of Printed Antenna Subarrays, "*IEEE Transactions on Antennas and Propagation,* vol. 40, No. 6, pp. 666–674, Jun. 1992.

Elliott, R.S., et al., "Parasitic Arrays Excited by Surface Waves, "*IEEE Transactions on Antennas and Propagation,* pp. 140–142, Jul. 1955.

Staraj, Robert, et al., "Infinite Phased Arrays of Microstrip Antennas with Parasitic Elements: Application to Bandwidth Enhancement, "*IEEE Transactions on Antennas and Propagation,* vol. 42, No. 5, pp. 742–746, May 1994.

Seth, Devendra P.S., et al., "On Linear Parasitic Array of Dipoles with Reactive Loading, "*IEEE Transactions on Antennas and Propagation,* vol. AP–21, No. 3, pp. 286–292.

Theil, David V., et al., "Electronic Beam Steering in Wire and Patch Antenna Systems Using Switched Parasitic Elements, "*IEEE 0–7803–3216–4/96,* pp. 534–53 7, 1996.

Lin, C.J., et al., "Parasitic Array of two Loaded Short Antennas, "*IEEE Transactions on Antennas and Propagation,* vol. AP–21, No. 6, pp. 852–855, Nov. 1973.

Huang, John, et al., "Microstrip Yagi Array Antenna for Mobile Satellite Vehicle Application, "*IEEE Transactions on Antennas and Propagation,* vol. 39, No. 7, pp. 1024–1030, Jul. 1991.

Kahn, Walter K., "Currents on Generalized Yagi Structures, "*IEEE Transactions on Antennas and Propagation,* vol. AP–27, No. 6, pp. 788–797, Nov. 1979.

Zhang, Yimin, et al., "Opened Parasitic Elements Nearby a Driven Dipole, "*IEEE Transactions on Antennas and Propagation,* vol. AP–34, No. 5, pp. 711–713, May 1986.

Korekado, Toshikazu, et al., "Design Method of Yagi–Uda Two–Stacked Circular Loop Array Antennas, "*IEEE Transactions on Antennas and Propagation,* vol. 39, No. 8, pp. 1112–1118, Aug. 1991.

Cheng, David K., et al., "Optimun Element Spacings for Yagi–Uda Arrays, "*IEEE Transactions on Antennas and Propagation,* vol. AP–21, No. 5, pp. 615–623, Sep. 1973.

Chen, C.A., et al., "Optimum Element Lengths for Yagi–Uda Arrays, "*IEEE Transactions on Antennas and Propagation,* vol. AP–23, No. 1, pp. 8–15, Jan. 1975.
Viezbicke, Peter P., "Yagi Antenna Design, "*US Government Printing Office Washington SD Catalog No. C13.46:688),* 27 pages, Dec. 1976.
Ebrenspeck, H.W., et al., "Two–Dimensional Endfire Array with Increased Gain and Side Lobe Reduction, " pp. 2 17–230.
Lindsay, James E. Jr., "A Parasitic End–Fire Array of Circular Loop Elements," *IEEE Transactions on Antennas and Propagation,* pp. 697–698, Sep. 1967.
Vaughan, Rodney, Switched Parasitic Elements for Antenna Diversity, *IEEE Transactions on Antennas and Propagation,* vol. 47, No. 2, pp. 309–405, Feb. 1999.
Dinger, Robert J., "A Planar Version of a 4.0 GHz Reactively Steered Adaptive Array," *IEEE Transactions on Antennas and Propagation,* vol. AP–34, No. 3, pp. 427–431, Mar. 1986.
Dinger, Robert J., "A Computer Study of Interference Nulling by Reactively Steered Adaptive Arrays," *IEEE CH2043–8/84/0000–0807,* pp. 807–810, 1984.
Dinger, Robert J., "Reactively Steered Adaptive Array Using Microstrip Patch Elements at a 4 GHz," *IEEE Transactions on Antennas and Propagation,* vol. 32, pp. 848–856, Aug. 1984.
Dinger, Robert J., "A Microstrip Power Inversion Array Using Parasitic Elements, " pp. 19 1–194.
Dinger, Robert J., "Adaptive Microstrip Antenna Array Using Reactively Terminated Parasitic Elements, " pp. 300–303.
Dinger, Robert J., Spatial Prefiltering of Interference Sources Using Subarrays of Reactively Steered Adaptive Arrays, pp. 965–968.
Harrington, Roger F., "Reactively Controlled Directive Arrays," *IEEE Transactions on Antennas and Propagation,* vol. AP–26, No. 3, pp. 390–395, May 1978 Note: This key paper was referenced by inclusion originally in Dinger.
Schlub, R., et al., "Dual Band Switched–Parasitic Wire Antennas for Communications and Direction Finding, " from Asia–Pacific Microwave Conference 2000, Sydney, pp. 28 1–285, 2000.
Preston, Stephanie L., et al., "Direction Finding Using a Switched Parasitic Antenna Array," *IEEE 0–7803–41 78–/3/97,*pp. 1024–1027.
Preston, Stephanie L., et al., "Base–Station Tracking in Mobile Communications Using a Switched Parasitic Antenna Array," *IEEE Transactions on Antennas and Propagation,* vol. 46, No.6, pp. 841–844, Jun. 1998.
Schaer, B., "Simple Algorithm for the Control of Reactances in Beam Steering Applications with Parasitic Elements, "*IEEE 0–7803–819 7–1/03,* 2003.
Kagoshima, Kenichi, "Pattern Control Antennas for Wireless Access Systems," *IEEE 0–7803–6369–8/00,*2000.
Harrington, Roger F., et al., "Electromagnetic Scattering by Loaded Wire Loops," *Radio Science,* vol. 1, No. 3, pp. 347–352, Mar. 1996.
Schindler, J.K., et al., "The Control of Electromagnetic Scattering by Impedence Loading, " *Proceedings of the IEEE,* pp. 993–1003, Aug. 1965.
Harrington, Roger F., et al., "Optimization of Radar Cross Section of N–Port Loaded Scatterers," *IEEE Transactions on Antennas and Propagation,* vol. AP–22, No. 5, pp. 697–701, Sep. 1974.
McMahon, E. Lawrence, "Circuit Realizations of Impedance Loading for Cross Section Reduction," *Air Force Cambridge Research Laboratories,* AFCRL–70–05 14, Scientific Report No. 8, Sep. 1970.
Chen, Kun–Mu, "Minimization of End–Fire Radar Echo of a Long Thin Body by Impedance Loading," *IEEE Transactions on Antennas and Propagation,* vol. AP–14, No. 3, pp. 3 18–323, May 1966.
Garbacz, Robert J., et al., "Antenna Shape Synthesis Using Characteristic Modes," *IEEE Transactions on Antennas and Propagation,* vol. AP–30, No. 3, pp. 340–350, May 1982.
Liepa, V.V., et al., "Modification to the Scattering Behavior of a Sphere by Reactive Loading," *Proceedings of the IEEE,* pp. 1004–1011, Aug. 1965.
Bevensee, R.M., "Radar Cross Section Reduction by Lumped, Linear, Passive Loading," *Lawrence Livermore National Laboratory.*
Harrington, Roger F., et al., "Control of Radar Scattering by Reactive Loading," *IEEE Transactions on Antennas and Propagation,* vol. AP–20, No. 4, pp. 446–454, Jul. 1972.
Kolsrud, Arild T., "Frequency Tunable CPW–Fed CPS Dipole Antenna Using Varactors," *IEEE 0–7803–4478–2/98,* pp. 308–311, 1998.
Linden, Derek S., "In–situ Evolution of a Reconfigurable Antenna," *IEEE 0–7803–6599–2/01,*pp. 5–2333–5–233 8, 2001.
Coleman, C.M., et al., "Self–Structuring Antennas, "*IEEE Antenna's and Propagation Magazine,* vol. 44, No. 3, pp. 11–22, Jun. 2002.
Schaubert, Daniel H. et al., "Post–Tuned Microstrip Antennas for Frequency–Agile and Polarization–Diverse Applications, " *US. Army Electronics Research and Development Command,* Harry Diamond Laboratories, HDL–TM–81–8, 30 pages, Mar. 1981.
Schaubert, Daniel H., "Conformal Dielectric–Filled Edge–Slot Antennas for Bodies of Revolution, " *US. Army Materiel Development and Readiness Command,* Harry Diamond Laboratories, HDL–TR–1837, 25 pages, Sep. 1977.
Schaubert, Daniel H., "Conformal Dielectric–Filled Edge–Slot Antennas with Inductive–Post Tuning, " *IEEE Transactions on Antennas and Propagation,* vol. AP–27, No. 5, pp. 713–716, Sep. 1979.
Schaubert, Daniel H., et al., "Microstrip Antennas with Frequency Agility and Polarization Diversity, " *IEEE Transactions on Antennas and Propagation,* vol. AP–29, No. 1, pp. 118–123, Jan. 1981.
Schaubert, Daniel H., et al., "Series–Fed, Dielectric–Filled, Edge–Slot Antennas, " *IEEE CHJ 456–3/79/0000–0142,* pp. 142–145, 1979.
Sengupta, Dipak L., et al., "Theory of the Input Behavior of a Dielectric–Filled Edge–Slot Antenna," *IEEE CHJ 456–3/79/0000–0138,* pp. 138–141, 1979.
Richards, William F., et al., "Theoretical and Experimental Investigation of a Microstrip Radiator with Multiple Lumped Linear Loads," *Electromagnetics,* 3:371–387, 1983.
Waterhouse, R.B., "Theoretical Investigation of the Effects of Substrate Parameters on the Performance of Diode Loaded Microstrip Patches," *IEEE 0–7803–2009–3/94,* pp. 790–793, 1994.
Waterhouse, R.B., et al., "Frequency Agile Microstrip Rectangular Patches Using Varactor Diodes," *IEEE 0–7803–0730–5/92,* pp. 2188–2191, 1992.

Waterhouse, Rod B., et al., "Scan Performance of Infinite Arrays of Microstrip Patch Elements Loaded with Varactor Diodes," *IEEE Transactions on Antennas and Propagation,* vol. 41, No. 9, pp. 1273–1280, Sep. 1993.

Robert, Bernard, et al., "Capacitors Provide Input Matching of Microstrip Antennas," *Microwaves* & RF, pp. 103–106, Jul. 1994.

Purchine, Michael P., et al., "A Tunable L–Band Circular Microstrip Patch Antenna," *Microwave Journal,* pp. 80–88, Oct. 1993.

Sor, James, et al., "Multi–Mode Microstrip Antennas for Reconfigurable Aperture," *IEEE 0–789306369–8/00,* pp. 318–320, 2000.

Chang, B.C. C., et al., "A Reconfigurable Leaky Mode/Patch Antenna Controlled by PIN Diode Switches," *IEEE 0–7803–5638–X/99,* pp. 2694–2697, 1999.

Yang, F., et al., "Switchable Dual–band Circularly Polarised Patch Antenna with Single Feed," *Electronics Letters,* vol. 37, No. 16, pp. 1002–1003, Aug. 2, 2001.

Huff, G.H., et al., "A Small Array of Boresight to Endfire Radiation Reconfigurable Antennas," pp. 147–161, Allterton Antenna Conference, Sep. 17–19, 2003.

Priebe, D.A. et al., "Bandwidth Enhancement of Small Scatterers by Means of Passive Loading", $16^{th}$ Annual Symposium on USAF Antenna Research and Development, Robert Allerton Park, University of Illinois, Oct. 11–13, 1966.

* cited by examiner

Jammer Gain GPS Gain

Jammer Gain GPS Gain

SMALL CONTROLLED PARASITIC ANTENNA SYSTEM AND METHOD FOR CONTROLLING SAME TO OPTIMALLY IMPROVE SIGNAL QUALITY

RELATED APPLICATIONS

This application claims the benefit of U.S. Provisional Application Ser. No. 60/308,097 which was filed on Jul. 30, 2001, the disclosure of which is incorporated herein by reference.

TECHNICAL FIELD

The present invention relates in general to the field of small adaptable antenna systems. By 'small' is meant an antenna system whose largest dimension is about ½ wavelength or less at the lower end of the operational band. In particular the invention relates to the use of loaded parasitic components within the radiating aperture of an antenna element for the purpose of controlling the RF properties of the antenna element. It also relates to the use of a feedback and control subsystem that is part of the antenna system and which periodically adjusts the RF properties of the parasitic components based on some observed metric of the received waveform. This small antenna system will be referred to as a controlled parasitic antenna (CPA). By using a feedback subsystem to control the electromagnetic properties of the antenna aperture, this antenna system can provide multi-functionality and/or mitigate problems associated with the reception of an interfering signal (or signals) within a very compact volume. The interfering signal could actually be the desired signal arriving along a reflected path.

BACKGROUND

Often in wireless communications interfering signals share the same frequency band (or channel within the band) as the desired signal. As noted above, the interfering signal can be the desired signal arriving along a reflected path or paths. This will be referred to as coherent interference, which can lead to partial cancellation of the signal strength. This in turn can result in signal fade or dropout.

An independent interfering signal will be referred to as incoherent interference. This type of interference is often characterized as either broadband or narrow band interference. Broadband interference is spread over a large fraction of or all of the bandwidth associated with the desired signal. This interference looks like noise to the system and will effectively reduce the signal to noise ratio (SNR) and can swamp the desired signal or at least reduce its quality. Narrowband interference occupies a smaller fraction of the signal band. Applying narrowband-filtering or narrowband-processing techniques to the antenna output can sometimes mitigate its deleterious effect.

Interference may unintentionally compete with the desired signal, as is the case in an area where two co-channel radio stations have about the same strength. In some situations (warfare) intentional interference can occur. Sometimes the interfering signal has been intentionally modulated so as to mimic some key aspect of the desired signal. This can corrupt the information content that the receiver outputs. For digital communications both coherent and incoherent interference can lead to unacceptable bit error rates, loss of signal lock, or a corruption of the information or message in the desired signal.

The conventional method of designing a wireless system for interference rejection is to receive outputs from two or more antenna elements. A processor uses these outputs to determine a complex weight or set of weights for each output. These are applied to the measured outputs to produce weighted outputs. These weighted outputs are then combined to form a single output. If the weights are chosen correctly, the effective power of the interference in the final output will be significantly reduced relative to the measured outputs and the desired signal strength will be enhanced. The resulting antenna system is often referred to as an adaptive phased array. If the adaptive array has only a few elements (at least 2 but no more than about 10), then it is often referred to as a "smart antenna." Actually, the upper bound on the number of elements in "smart" antennas simply reflects current practices and conventions of terminology. In principle this number could be arbitrarily large.

A number of smart antenna systems for communication applications have been described. The "smarts" in such systems make use of a digital signal processor. The inputs to such a processor are the received element signals after the initial front end filtering and down conversion. The processor determines a set of weights that are used to combine the element signals in such a way so as to reduce the interference in the final output. This approach to interference mitigation is performed solely within an electronic package that has two or more antenna input ports. Each such port is connected to an antenna element via an RF (radio or carrier frequency) transmission line of some type. The antenna elements are designed to have coverage that is as broad as possible but are offset from each other in position and/or orientation. These offsets have to be large enough so that there are sufficient signal phase differences among the individual element outputs. The processor uses these phase differences to advantage in determining the appropriate weights. For adequate spatial filtering element separations ranging from 0.3 to 0.5 carrier wavelength are required.

A number of U.S. patents disclose variations on the theme of the type of smart antenna described above. U.S. Pat. No. 6,122,260 discloses a smart antenna system for CDMA wireless applications. This system uses multiple antenna elements and transceivers as well as a processor that exploits spatial and code diversity. U.S. Pat. No. 6,137,785 discloses a smart antenna system for a wireless mobile station. It makes use of at least two antenna elements and a receiver structure for canceling co-channel interference. U.S. Pat. No. 6,177,906 discloses a multimode iterative adaptive smart antenna processing method and apparatus that makes use of multiple antennas and receiver units. A new method for weight selection is also disclosed. U.S. Pat. No. 6,229,486 discloses a subscriber based smart antenna, which uses the outputs from multiple elements to form multiple beams. A controller picks the best beam at any particular time. U.S. Pat. No. 6,252,548 discloses a transceiver arrangement for a smart antenna system in a mobile communication base station. Again, this system uses multiple elements, multiple transceivers, digitizers, and a digital processor. U.S. Pat. No. 6,369,757 discloses a method for a multi-element smart antenna system.

For many of the systems classified as "smart" antennas the total antenna aperture (containing several elements) tends to be a minimum of 1 to 2 wavelengths across. Often the aperture needs to be much larger than this. The elements are typically passive (have fixed properties) and all the interference mitigation is provided at the level of the down converted signal within the system electronics package. Thus, the RF or front end of the system is not affected by the interference mitigating functions of the "smart" antenna system. Typically the elements are designed so that they operate best at a specific carrier frequency as well as across a fairly narrow band (a few per cent relative bandwidth) about that frequency. Dual tuned elements also exist and could possibly be used for "smart" antenna applications.

Conventional "smart" antenna systems can be very effective in mitigating the impact of one or several interfering sources. However, they also have significant drawbacks. Among the most significant ones are:

1. Multiple antenna outputs must be handled simultaneously. This means multiple matching networks, filters, and down-converters and possibly multiple LNAs at the front end. For some applications, the system will also require multiple AD converters.
2. The required total antenna aperture may be unacceptably large for many applications. Such apertures will range from 1 to 2 wavelengths to several wavelengths across.
3. Typically the system will be restricted to a fairly narrow range of carrier frequencies. This limitation occurs at the RF front end. The down converting electronics could be designed to provide down conversion over a wide range of frequencies, and the rest of the electronic package (including the processor) is limited by the bandwidth and is basically unaffected by the carrier frequency.

A number of U.S. patents disclose variations on antenna system designs that make use of parasitic elements. A number of these specifically describe arrays of parasitics within multi-element arrays of active elements. Examples are as follows. U.S. Pat. No. 5,294,939 discloses a multi-element reconfigurable antenna system that uses microstrip patch elements—both active and parasitic. The parasitic element(s) could be passive or loaded with variable impedances. The emphasis is on array applications where the overall system size would be at least a few wavelengths. U.S. Pat. No. 6,040,803 discloses a multi-element antenna system that makes use of passive parasitics to provide dual band capabilities. U.S. Pat. No. 6,317,100 discloses a planar antenna array with passive parasitic elements to provide multiple beams of varying widths. In this system a single active element is used for transmitting and multiple elements are used for receiving.

A number of single element designs with passive parasitics are also disclosed in the prior art. Examples are as follows. U.S. Pat. No. 5,923,305 discloses a dual band helix with a second passive parasitic helix that is either collocated with or adjacent to the active element. The presence of the parasitic enables the antenna element to be tuned at two different bands. U.S. Pat. No. 6,133,882 discloses an antenna element that uses parasitics for parasitic feed coupling to a radiating element. U.S. Pat. No. 6,181,279 discloses a patch antenna element with an electrically small ground plane. Peripheral parasitic slabs are used to help tune the antenna assembly to a desirable frequency. U.S. Pat. No. 6,198,943 discloses the use of a passive parasitic for dual band tuning of an internal loop dipole antenna. U.S. Pat. No. 6,249,255 discloses an antenna assembly and associated method that makes use of a passive parasitic to reduce the gain in the direction of the user of a communication device. U.S. Pat. No. 6,285,327 discloses a substrate antenna element that makes use of a passive patch parasitic to tailor the antenna characteristics.

In "Axial Mode Helical Antennas" Nakano et al. describe the use of a passive helical parasitic element with an active helical element. The parasitic element is shown to have a noteworthy impact on the element gain pattern. In "A Planar Version of a 4.0 GHz Reactively Steered Adaptive Array" Dinger describes a planar array that includes a single active microstrip element and eight closely coupled parasitic microstrip elements that are reactively loaded with variable impedances. The parasitic elements are exterior to the aperture of the active radiating element. The dimensions of the array are about 1.0×1.5 wavelengths. Null steering for the active element at 4.0 GHz is demonstrated for the active element.

SUMMARY OF THE INVENTION

The present invention provides an adaptive capability for mitigating the adverse impact of interference or jamming (hostile interference) to communication systems. Unlike, the "smart" antenna concept, it avoids the three drawbacks mentioned above. In particular it uses a single antenna output port and has an aperture whose largest dimension is about one-half wavelength or less. It too makes use of a digital signal processor. However, it provides interference control not by means of multiple sets of output weights but rather by adaptively setting the biases applied to active circuits in the antenna aperture. These circuits are attached to parasitic elements that are contained within the radiating aperture. The variable impedances of these circuits act in a manner that is analogous to processor weights. However, they are applied in the RF front end where they can affect much more antenna multifunctionality than is possible with conventional "smart" antenna concepts. The processor in this invention is actually part of a feedback and control loop that adapts the impedance circuits to minimize or maximize some metric of the received output from the antenna. This antenna system design can also be used to provide tuning control of the antenna element. This provides the possibility of operating over a larger frequency range than is typically the case in conventional antenna system designs.

The jammer gain pattern and the GPS (RHCP) patterns are shown for both the L1 and L2 bands. Acquisition and tracking thresholds are also shown.

Figure 6:
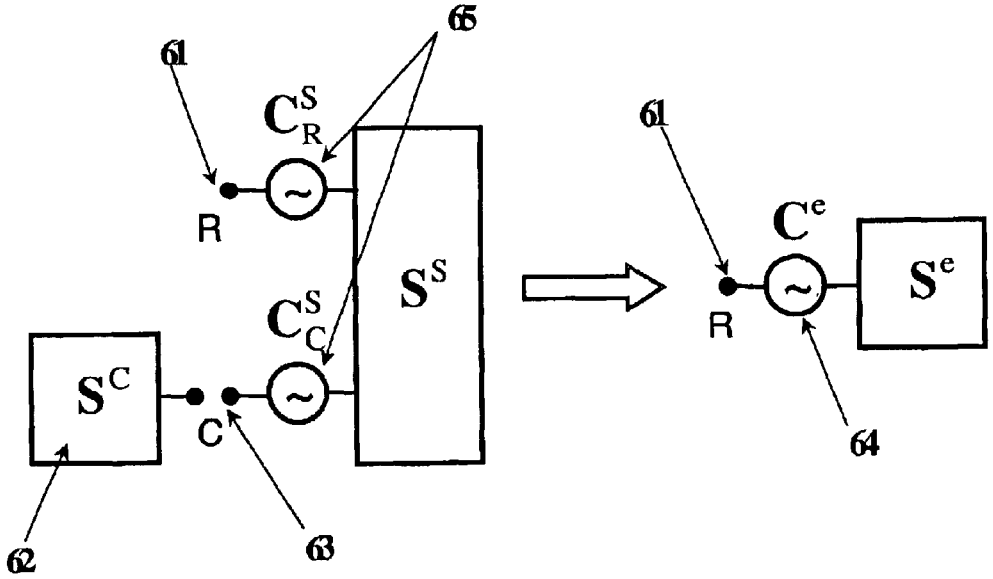
FIG. 6 depicts how the structure feed and load circuit networks combine to form the antenna system network.
Figure 13:
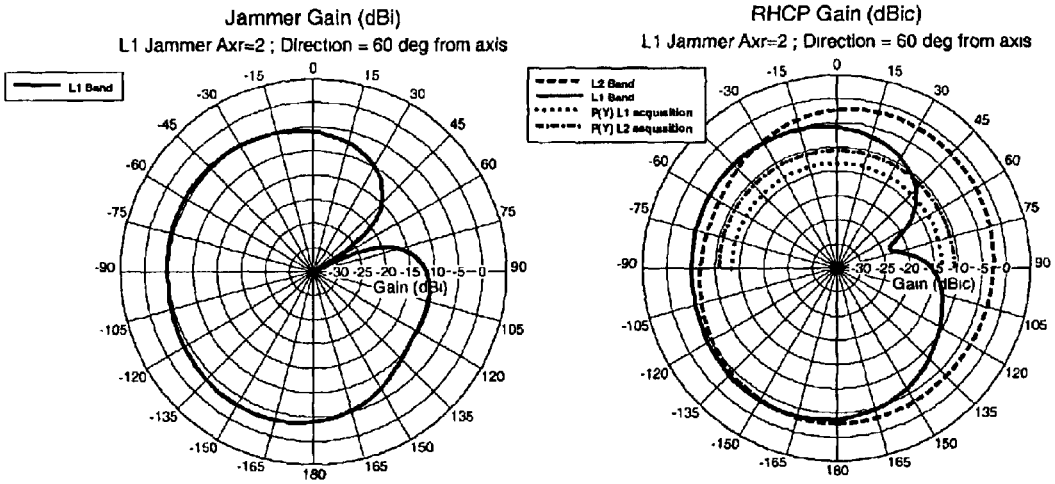

FIG. 13 depicts the antenna patterns of the FIG. 6 system after adapting to a nearly RHCP jammer (axial ratio of 2) at 60 degrees with power in only the L1 GPS band. The jammer gain pattern and the GPS (RHCP) patterns are shown for both the L1 and L2 bands. Acquisition and tracking thresholds are also shown.

DETAILED DESCRIPTION OF THE INVENTION

Figure 1:
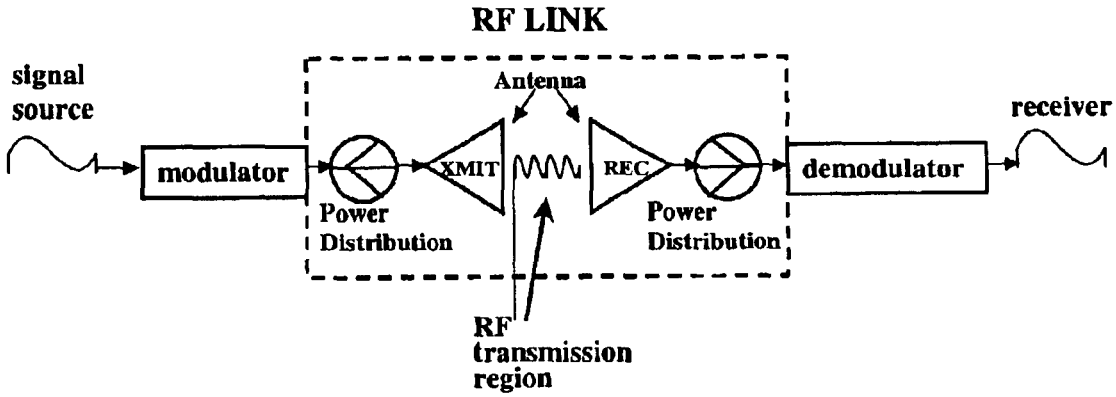
FIG. 1 depicts the RF portion of a communication link.

As a background to the invention, the manner in which the RF properties of CPA devices can be controlled will now be described. In the context of this specification RF refers to the frequency (or range of frequencies) of a transmission which propagates through space. Also described herein is how the function of the CPA differs from conventional and other state of the art approaches to antenna pattern control and interference mitigation. An antenna is an RF device. It is important to emphasize that in a CPA system control and adaptability are applied in the antenna aperture. This is RF control. FIG. 1 is meant to illustrate what is meant by RF control.

FIG. 1 could be applied to any situation involving an RF wireless link. Such applications would include communication between separate points, broadcasting, or radar. A signal waveform is generated by some source and this is used to modulate an RF carrier and so produce a modulated RF waveform. A modulator accomplishes this. This RF waveform enters the RF link via one or more connection points or ports. This modulated RF signal is then projected into the transmission region via the RF front end, which includes the antenna element or sometimes several antenna elements (labeled XMIT). The receive side of the link also has an RF front end, which includes an antenna or several antenna elements (labeled REC). This RF front end directs the signal to a port or set of ports from which it enters a subsystem that demodulates it (removes the carrier by means of a demodulator) and outputs the result to a receiver. RF control occurs within the RF link, which is indicated by the dashed line box of FIG. 1.

For both transmit (XMIT) and receive (REC) the RF front end usually consists of two basic parts. Often the same front end is used for both XMIT and REC. One of the basic parts is a power distribution system and the other is the antenna element or elements. The antenna elements are the system components that are designed to radiate RF energy into the transmission region. There could be one or many such elements in an antenna system. The distribution system carries RF power between the connection point or points and the antenna element or elements. This distribution system could be as simple as a section of coax with connectors at each end, or it could be a complicated microwave circuit consisting of such things as power dividers, hybrids, phase shifters, coaxes, connectors, and so forth. The connection points are referred to as ports. For transmission (XMIT) an antenna element radiates RF energy into the transmission region. For reception the antenna element is driven (or excited) by RF radiation that is in the transmission region. CPA devices are antenna elements and therefore the control they provide is contained within the antenna portion of the RF front end. This is one of the distinguishing characteristics of the CPA.

Figure 2:
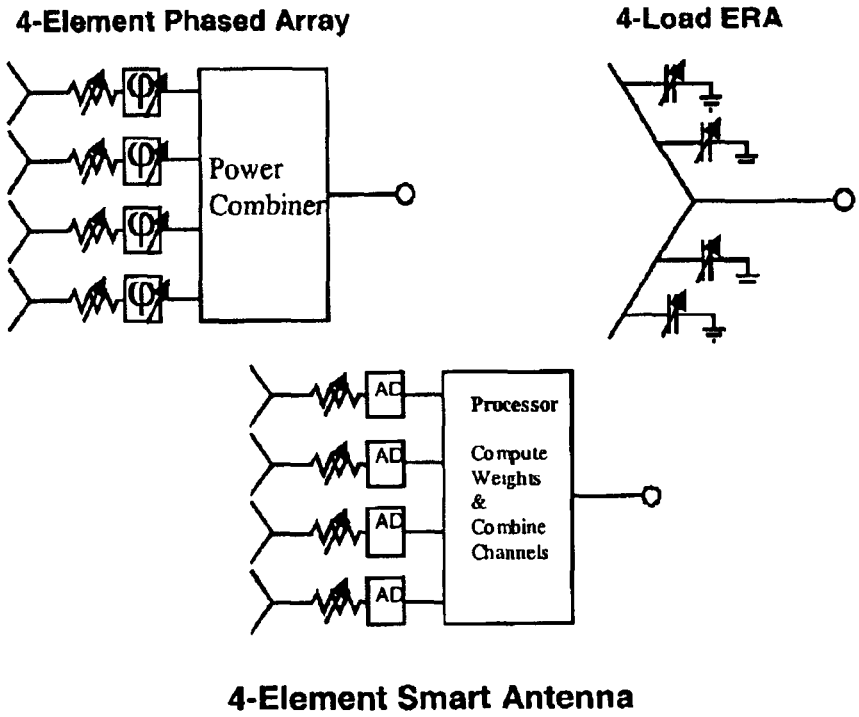
FIG. 2 depicts the distinguishing characteristics of phased array, smart antennas, and ERA systems.

Ideally, on the REC side of the link the system should receive a desired signal with as much signal energy as possible and it should reject undesired signals as much as possible. This is the main purpose of adaptive antenna systems. There are three basic ways of implementing such adaptive capabilities. These are illustrated in FIG. 2, which shows a 4-element phased array, a 4-element smart antenna, and a 4-load electronically reconfigurable antenna (ERA). The CPA is a member of the ERA category of antenna systems. The use of "4 elements" is for illustration purposes only. Actually there could be any number of elements or loads in these systems and the same discussion would apply. In the phased array there are multiple antenna elements and the distribution system joins these to a common output port. It is also possible to have several such output ports. RF control is applied in the distribution system by adjusting the time delay or relative phases in the lines connecting the elements to the power combiner. In the smart antenna system the control is applied after demodulation (not at RF). The antenna elements provide separate outputs (no power combiner), which are demodulated. There is an AD converter for each of these demodulated outputs. An adaptive processor provides control digitally.

The ERA applies adaptive RF control in the antenna aperture. The CPA invention is a special kind of ERA. With an ERA the RF properties are controlled via the mechanism of active electronic circuits that are embedded in the aperture. A CPA is characterized by the presence of parasitic elements, which are conducting structures placed in the aperture but not directly connected to the power distribution system. With a CPA, parasitic elements are directly connected to circuits that contain active control devices. These determine the impedance characteristics of the parasitic elements distributed in the antenna aperture. The control devices would typically be variable capacitors (varactors) of some type as illustrated in FIG. 2. The use of varactors allows for the control of the reactive portion of the parasitic impedance. However, variable resistances could also be included for some applications. The impedance properties of an active device can be controlled by varying a DC voltage (bias). In a CPA there may be one or several such biases that can be varied. The adaptation of the antenna properties is accomplished by properly adjusting these biases. The use of parasitics with controllable reactances as described above distinguishes the CPA from other types of ERA systems. The particular advantages of using controllable parasitics in this manner will be discussed using the well-established theory of RF networks.

The adaptive nature of this invention can best be understood within the context of RF network theory. Those aspects of this theory that pertain directly to the invention are summarized in the following. This summary also provides a means of comparing and contrasting the CPA approach with the adaptive phased array or "smart antenna" approach. This helps to clarify the innovativeness of the CPA concept and to show how it is distinctly different from the current state of the art adaptive antenna technologies.

Figure 3:
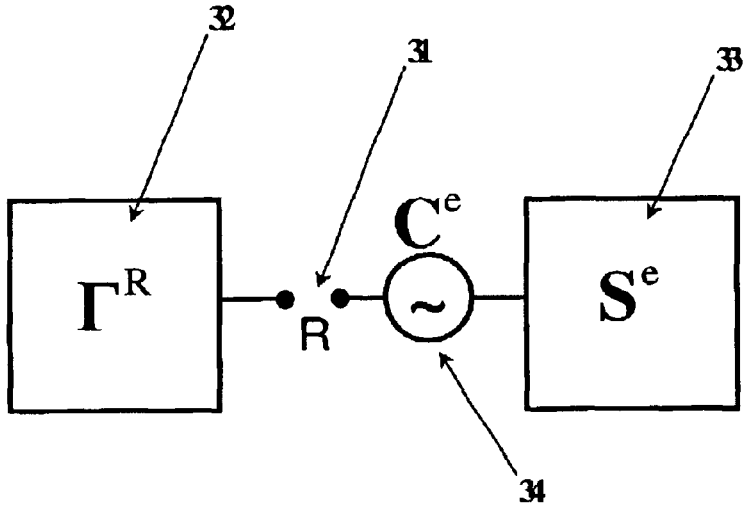
FIG. 3 depicts the reference plane R for receiver and antenna system networks.

The antenna RF properties can be specified by making use of a set of input ports. These serve as measurement reference points for the RF system. This is illustrated in FIG. 3. This set of ports (often there is only one port in this set) will be designated as R (31) or as the R-plane reference for the system. These R ports (or this R port) correspond to the connection points that were mentioned above in the discussion that referenced FIG. 2. In FIG. 3 the network to the left of R is the receive and/or transmit system (32). The latter consists of a cascade (or cascades) of elements such as splitters, amplifiers, mixers, filters, detectors, and digitizers. The scattering matrix looking into the receiver and/or transmitter system from R is designated as $\Gamma^R$. The source network to the right of R is the RF front end system. This consists of the antenna structure as well as any RF link system that is present to connect the antenna to the reference port (or ports) R. In addition, the RF front end system will contain the control circuits (elements) that are connected to the parasitic elements. It is the latter that make this a CPA. The scattering matrix of the RF front end is $S^e$ (33) and the source power wave vector is $C^e$ (34). These power wave components are due to sources whose electromagnetic (em) fields are impinging on the antenna as well as random noise sources within the feed system itself. It is defined as the matched power wave ($\Gamma^R=0$ condition) at R that results from all these external sources. Both $S^e$ and $C^e$ depend on the variable load condition. Thus, they are functions of the load values. It is this load dependency that gives the CPA its adaptability. In addition $C^e$ is a function of the source properties as well.

In the following discussion it is implicitly assumed that the system is operating in the receive mode since the system would typically be adapting in this mode of operation. However, the RF system that is adapting will usually be a reciprocal system and, thus, there will be corresponding reciprocal effects on the transmit properties. Ideally, the system will be designed and the reference R chosen so that $\Gamma^R=0$. In that case the power received at R will be $(C^e)\bigstar\cdot C^e$. At RF the source power wave vector can be written as a sum of three contributions as follows, $$C^e=C_s^e+C_i^e+C_n^e \tag{1}$$

where subscripts s, i, and n refer, respectively, to contributions from the desired signal (or signals), the unwanted interference, and the noise. In the present context an important distinction between the interference and noise is that the interference can be attributed to discrete directional sources and is sensitive to the directional and polarization properties of the antenna pattern. The noise is typically (though not always) independent of the pattern. The noise consists of three basic contributions, which are background noise, antenna aperture noise, and system (or receiver) noise. It is the background portion of the noise that can depend on the pattern. In the following discussion it is implicitly assumed that the system noise is the dominant noise source.

The dependence of $C_i^e$ and $C_s^e$ on the variable load values is exploited when using a CPA to mitigate interference. In some situations the interference may actually have one or more contributions from the source of the desired signal. This would be coherent interference and usually results from multi-path propagation. The noise contribution will be assumed to be dominated by the receive system noise which is independent of the pattern. All three terms on the right side of equation (1) can depend on the loads, although, the effects of loading on the noise can usually be assumed to be negligible. The basic idea of the CPA is to have a feed back mechanism that causes the control loads to converge to values that eliminate or significantly reduce the contribution of the interference $C_i^e$ and/or enhance the contribution of the desired signal $C_s^e$. It is important to emphasize that for a CPA this reduction and/or enhancement occurs in the antenna portion of the RF front end of the system.

The RF Front End System and the Antenna Element System

This section will present a network description of the system. The primary goal is to show how the control loads affect the power wave source vector $C^e$ that is depicted in FIG. 3.

Figure 4:
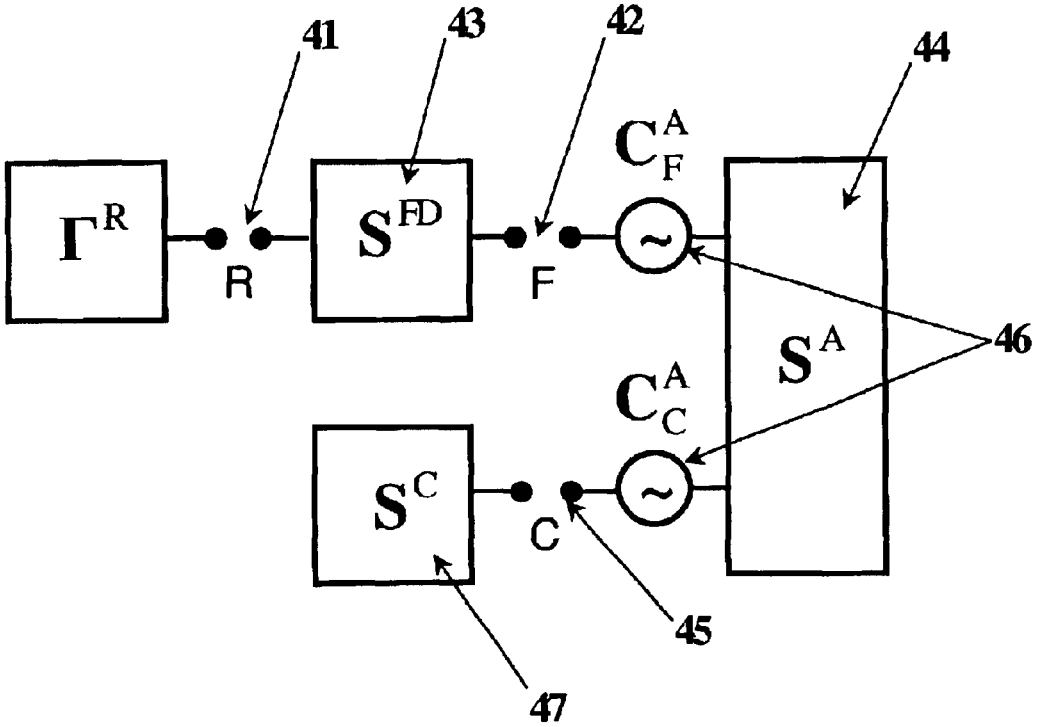
FIG. 4 depicts a block diagram of the CPA system.

FIG. 4 shows a top-level depiction of the RF front-end system network. In FIG. 4 everything to the right of reference plane R (41) is the RF front end. The points F and C are meant to depict reference planes and as such could represent several ports each. Reference plane F (42) corresponds to the antenna feed ports. The network coupling F and R is the feed distribution network (43). The S-matrix $S^{FD}$ couples F and R ports among each other. This feed distribution network could simply be made up of connectors and transmission lines. It could also contain other types of power distribution devices such as power dividers, hybrids, or butler matrices. In some types of applications it may contain LNAs or phase shifters. Within the context of this description it is important to note that the properties of $S^{FD}$ can be considered as being fixed. For the adaptive phased array approach illustrated in FIG. 2, the feed distribution system would contain variable phase shifters and, thus, the properties of $S^{FD}$ would not be fixed. The adaptive control offered by that approach is actually contained in the feed system. That is not the case for the CPA. Thus this indicates a clear distinction between the CPA and the adaptive phased array approach discussed earlier. The network represented by $S^A$ is the antenna element network (44). One could also refer to this as the antenna structure network or the radiating network. This network characterizes the antenna element (or elements) with the embedded parasitic elements. It is referenced to the two planes F (the feeds 42) and C (the control ports 45). The latter ports are connected to the parasitic elements. The network characterized by scattering matrix $S^C$ is the control network. The antenna element network is a source network with sources represented by the vectors $C_F^A$ and $C_C^A$ (46). At the F (42) and C (45) ports, these vectors correspond to the received power due to all external sources under the condition that matched loads (characteristic impedance $Z_O$) replace the networks to the left of F and C (in FIG. 4). Under that condition the squared magnitude of each component of the power wave vector would be the power received at the corresponding port due to all external sources.

Figure 5:
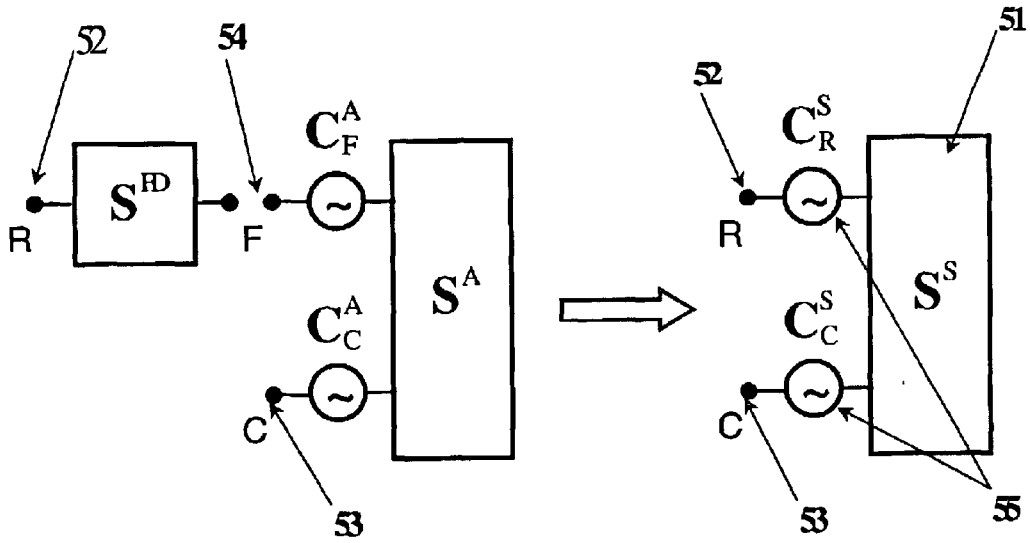
FIG. 5 depicts how the feed distribution and antenna structure networks can be combined to form the equivalent structure-feed network.

At R (41) the antenna system in FIG. 4 can be characterized by the equivalent representation depicted in FIG. 3. We wish to focus on the relationships between the two representations illustrated by these two figures. Of particular concern will be the relationships between $C^e$ (34 in FIG. 3) and each of the external sources and the way in which the control loads enter into these relationships. In FIG. 4 the S-matrix $S^C$ (47) represents the network of the control load RF circuits. With an ERA the RF properties of the control network $S^C$ can be adaptively varied to optimize the characteristics of $C^e$. Specifically for a CPA type of ERA the C ports are terminations of parasitic elements. The specific use of parasitics has important advantages that will be discussed below. FIG. 5 depicts an equivalent circuit representation of the problem. It shows a reduction to the antenna structure-feed network (51) whose S-matrix is $S^S$. This network representation isolates two types of ports. One is the receiver reference ports (52) and the other consists of the control ports (53). The antenna structure-feed network is a source network that incorporates both the antenna structure network and the feed distribution network. The feed ports F (54) are internal to the structure-feed network and, thus, do not appear as external ports on the right side of FIG. 5. The matched source power vectors (55) at the R and C planes can be represented by $C_R^S$ and $C_C^S$. The antenna structure-feed representation is particularly useful for examining the effects of the control loads that are applied at the C ports. Note that the reduction process illustrated in FIG. 5 implicitly assumes that $S^{FD}$ has fixed properties. The CPA control is applied in the antenna structure not in the feed distribution system, as is the case with an adaptive phased array.

FIG. 6 depicts the reduction of the antenna structure-feed and control load networks to the equivalent representation at reference R (61) that is shown in FIG. 3. Here we show how $C^e$ is related to $S^S$, $S^C$, $C_R^S$, and $C_C^S$. The block matrix notation is used. Thus, for instance $S_{RC}^S$ represents the elements coupling ports R to the C ports and $S_{CC}^S$ represents the couplings among the C ports. The inverse of a matrix S will be represented as $\tilde{S}$. The appropriate relationship is, $$C^e = C_R^S + S_{RC}^S \cdot (\tilde{S}^C - S_{CC}^S)^{-1} \cdot C_C^S \tag{2}$$

Equation (2) shows how $C^e$ (64) relates to the impedances of the control network (2). In FIGS. 5 and 6 the antenna structure-feed network is represented with a source vector $C^S$. As already depicted, this consists of two sub-vector arrays $C_R^S$ and $C_C^S$ (5). One can write this as, $$C^S = \begin{pmatrix} C_R^S \\ C_C^S \end{pmatrix} \tag{3}$$

The vector $C^S$ is a sum of contributions from all external sources. In particular consider the contribution from a discrete source. In addition to its frequency dependence, the power wave vector of this source depends on the direction and polarization of the incident field arriving from the source. This can be expressed in terms of a normalized source vector $L^S$ (f;n) where n is a source index. One can write for source n, $$C^S(f;n) = \begin{pmatrix} L_R^S(f;n) \\ L_C^S(f;n) \end{pmatrix} \cdot a(f;n) \tag{4}$$

In equation (4) a(f;n) corresponds to available power from the source. If P(f;n) is the incident power density ($W/m^2$) due to the source, then it follows that, $$|a(f;n)|^2 = \frac{\lambda^2}{4\pi} P(f;n) \tag{5}$$

The normalized source vector $L^S$ (f;n) is a construct whose purpose is to provide insight into the way a CPA system operates. It is important to give some consideration to the way in which time is referenced in order to more fully understand the meaning of the normalized source vector associated with a discrete source. This is so since the contributions from all the different sources need to be properly synchronized if their combined output is to represent a true coherent sum. Suffice it to say that phase needs to be referenced to a fixed point in space that serves as a fixed phase center of the system. This phase center will not vary as the load setting changes. The time dependence of all incident field waveforms can in principle be referenced to the time at which they reach this fixed phase center. Specifically what this means is that if we were to remove the antenna and replace it with an idealized field sensor (unit gain) located at the origin (i.e. the fixed phase center) and with the same polarization as the source, then would correspond to the Fourier transform of the measured time signal due to that source. With the antenna present and ports F and C matched (impedance $z_o$), the Fourier transform of the corresponding signal received at these ports is given by (4). The phase of $L^S$ (f;n) is, therefore, referenced to the fixed phase c produce changes in the magnitudes and phases of the components of $L^S$ (f;n) as the load impedances change. However, the control loads do not affect the a(f;n) coefficients.

In the case of multi-path it may be necessary to associate more than one index n with an actual signal source. The different indices would correspond to the different propagation paths between the source and the receive system. It is convenient to think of these as representing correlated sources. This would be the case of coherent interference.

The Receiver System and Output

The power wave $C_s^e + C_i^e$ (see equation (1)) can be represented as a sum over the individual contributions of all discrete sources that contribute to the output at R. The sum makes use of the $L^S$ (f;n) and a(f;n) factors for each source.

Figure 7:
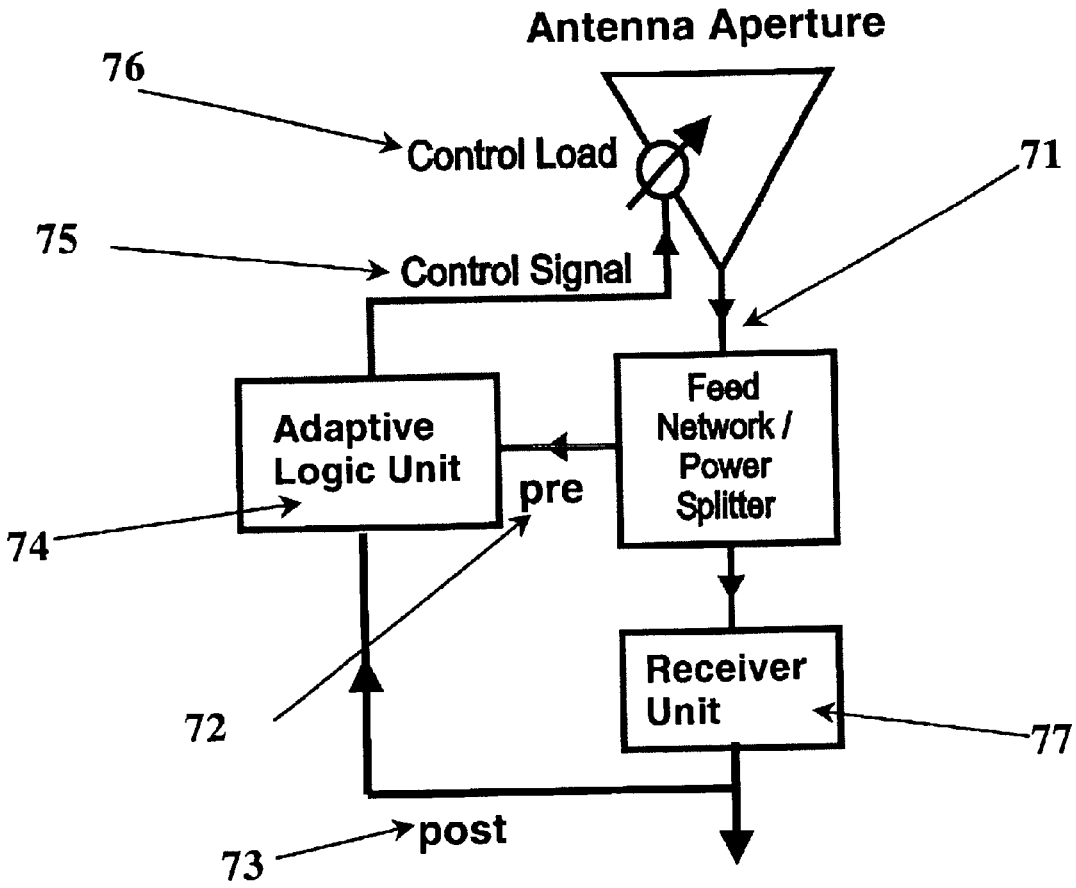
FIG. 7 depicts a basic block diagram of a CPA system.

In FIG. 3 the receiver system is simply represented as a load at the receive ports R (31). Ideally, this system will be designed so that at operational frequencies the impedance at these ports is $z_o$ and, consequently, $\Gamma^R=0$. The received power at these ports will then be represented by the power wave vector $C^e$ (see equation 1). The receiver system consists of a receiver feed network, a receiver unit, and output devices. These output devices could be such things as power rectifiers or digitizers. The receiver system conditions the input $C^e$ for output to these devices. It is characterized by a cascade (or cascades) of elements such as splitters, amplifiers, mixers, and filters. FIG. 7 illustrates the role of the receiver system and the feedback and control loop for an adaptive CPA system. Reference R (71) is shown. The CPA makes use of a feedback loop to adaptively determine the bias settings that in turn control the load values. This loop will contain an adaptive logic unit (74), a control signal (DC) circuit (75), and the active control load devices (76). This feedback loop can tap the output either before (pre-) (72) or after (post-) (73) the receiver (77). There might be situations where both pre and post feedback loops are used. The choice of configuration (pre-receiver or post-receiver) depends on the application. Both possibilities are illustrated in the FIG. 7. For the pre-receiver case (72) a power splitter in the link sends a specified percentage of the received power to the feedback loop and the rest goes to the receiver. Usually an amplifier is included in the link so that the splitter does not significantly degrade the noise figure.

Now let us refer to a specific output. This could be a receiver output (73) or an output to the feedback loop in the pre-receiver (72) configuration. A receiver link transfer function $U^o$ will relate the output $V^o$ to the input $C^e$. In what follows it is assumed that this link contains a band-pass filter to reject signal energy that is outside of some narrow band centered at an RF receive frequency $f^r$. The output will be linearly related to the input with the form, $$V^o = U^o \cdot C^e \tag{6}$$

Such a transfer function is typically a product of several transfer functions that represent the various steps in the cascade leading from the R (71) port or ports to the output. These steps will include one or more filters and may also include mixers for down conversion. Since the output will be narrow banded and possibly centered at some frequency $f^l$ different from $f^r$, it is convenient to express the factors in (6) as functions of the frequency F which is defined relative to the center frequency. Thus at RF, $F=f-f^r$ and at the intermediate output frequency $F=f-f^l$. A receiver link gain G can be associated with the magnitude $U^o$. Now consider the portion of the output $V_d^o$ that is due to discrete sources. In equation (1) these are the ones designated by subscripts s and i. It follows that, $$V_d^o(F) = U^o(F) \cdot \sum_k L^e(F;k) \cdot a(F;k) \tag{7}$$

where the summation is over all discrete sources, $L^e$ (f;k) is the effective normalized power wave vector of source k at RF frequency $f^r$+F, and a(F;k) is the complex amplitude of the incident field due to source k at RF frequency $f^r$+F. The normalized vector $L^S$ (F;k) for source k can be expressed as (see equation (4) above), $$L^S(F;k) = \begin{pmatrix} L_R^S(F;k) \\ L_C^S(F;k) \end{pmatrix} \tag{8}$$

The vector $L^e$ (F;k) can be expressed as a product of a matrix X(F) and $L^S$ (F;k). One has that $$L^e(F;k) = X(F) \cdot L^S(F;k) \tag{9}$$

From equation (2) this X matrix can be seen to be defined in terms of 2 block matrices as, $$X = (1, S_{RC}{}^S \cdot (\tilde{S}^C - S_{CC}{}^S)^{-1}) \tag{10}$$

where 1 is the identity matrix operating on R-plane indices. Note that X contains the control load dependence (represented by $\tilde{S}^c$) and is independent of the source properties. Keep in mind the difference between $L^e$(F;k) and $L^S$(F;k). The array $L^S$(F;k) represents the power received at ports R and C (65 in FIG. 6) for the condition that all these ports have impedance $z_o$ and the available power from the source has unit amplitude (see equations (4) and (5)). The factor $L^e$(F;k) represents the power received at R (31 and 61 respectively in FIGS. 3 and 6) for the condition R has impedance $z_o$, the C ports are loaded with the control load values, and the available power from the source has unit amplitude. Equations (9) and (10) provide the relationship between $L^e$(F;k) and $L^S$(F;k). In particular they show how the control loads affect $L^e$(F;k). Keep in mind that $L^e$(F;k) depends only on the frequency, direction, and polarization of the source. It is independent of the source signal or the available power in this signal. It also depends on the load settings as can be seen by examining (10). It is this latter RF dependence that is the main key to the adaptive operation of the CPA. Now in some cases the index k may refer to a desired signal source and in other cases it may refer to undesired sources (interference). The CPA adapts the load state so that contributions of the $L^e$(F;k) for interference are substantially reduced relative to the contributions from desirable signals.

Up to this point in the discussion there has been no limitation on the number of R ports. For the remainder of the discussion it is assumed that there is only one R port. This relates most directly to small antenna applications of the CPA concept. In that case vector $L^e$ has only one component, $U^o$ (F) is a scalar function, and X (see (10)) becomes a row vector. Equations (7) and (9) can now be combined to yield, $$V_d^o(F) = X(F) \cdot U^O(F) \cdot \sum_k L^S(F;k) \cdot a(F;k) \tag{11}$$

In equation (11) the summation is the matched condition source vector array resulting from all the discrete sources. A useful construct is to imagine that each of the ports R and C has a receive link identical to the actual one at port R. In that case, $$V^{Sd}(F) = U^O(F) \cdot \sum_k L^S(F;k) \cdot a(F;k) \tag{12}$$

would represent the array of all these outputs. Let vector $Z^{Sd}$ (t) be the time domain version of this array. This is essentially the set of base-band outputs due to all discrete sources for a system in which all the ports R and C are receive ports with link characteristics identical to the actual receive port R. The actual base-band output can be obtained by taking the Fourier transform of (11) and applying the convolution theorem. One gets that $$Z_d{}^o(t) = \int \hat{X}(t-t') \cdot Z^{Sd}(t')dt' \tag{13}$$

In (13) $\hat{X}$(t) is the transform of X(F). If the bandwidth of $U^o$(F) is sufficiently narrow, then X(F) can be approximated as its value at the center of the band. Representing this as X, equation (13) becomes, $$Z_d{}^o(t) = X \cdot Z^{Sd}(t) \tag{14}$$

Equation (13) or (14) is the base-band output due to all discrete sources. It is expressed as a sum over the antenna system ports (1 and 3 in FIG. 6). The array $Z^{Sd}$(t) would correspond to the outputs of an antenna array system if receivers were to be placed at these ports. "Smart antenna" systems make use of multiple outputs such as this. With a CPA the loads affect the vector X as can be seen from equation (10). It is instructive to imagine a set of receivers at the R and C ports to see the analogy between the CPA approach and the "smart antenna" approach. For the sake of argument as well as simplicity assume a narrow band receive system. In a "smart antenna" system the array processor would determine a suitable set of complex weights W and form the following sum over the elements, $$Z^{sum}(t) = W \cdot (Z^{Sd}(t) + N(t)) \tag{15}$$

A noise vector N(t) has been included in (15). This is the receiver noise referenced to the receiver input ports (or ports). For interference rejection the W vector would be adaptively chosen to minimize the sum channel power subject to suitable constraints. For the CPA approach the output would have the form.

$$Z(t) = X \cdot Z^{Sd}(t) + N(t) \tag{16}$$

The receiver noise term is included in (16). Equations (15) and (16) have a similar form. They both combine the elements of $Z^{Sd}$(t). The difference is that the W variables are a set of weights applied to the element outputs after they have passed through a set of receivers. The X variables are actually part of the antenna system transfer function and are applied at RF before the signal passes into the single receiver system. The X vector is a function of the control load variables. The feed-back system affects this vector via its ability to set the control load values.

There are at least two distinguishing features that enable CPA systems to be very effective adaptable antenna systems. The first has to do with the fact that the signal and interference control is performed at the RF front end before down conversion and A/D conversion. Both A/D and down conversion impose limitations on the effective dynamic range of the received waveforms. The CPA applies control prior to these system-imposed limitations on dynamic range. The vector X represents this RF front-end control of a CPA. The phase and magnitude characteristics of this vector are adaptable and controlled by a set of active RF circuits in the aperture. The second has to do with the fact that these active circuits are used to control the impedances of parasitic components within the aperture of the radiating element. The coupling between parasitics and the receive port R can be designed to be fairly weak but not negligible. For such designs the coupling terms (elements of $S_{RC}^{S}$ in (10)) would tend to range from about −10 to −15 dB. These appear to first order in X (see equation (10)). However, these terms appear to second order in the antenna impedance perturbations due to the loads. This is readily seen in the following expression, which shows how $S^e$ of FIG. 6 relates to the load impedances.

$$S^e = S_{RR}^{S+\Delta S} \tag{17.1}$$

$$\Delta S = S_{RC}^{S} \cdot (\tilde{S}^C - S_{CC}^{S})^{-1} \cdot S_{CR}^{S} \tag{17.2}$$

The portion of $S^e$ that depends on the control loads is $\Delta S$. If the coupling terms are on the order of −10 dB to −15 dB, then the active loads can be varied without seriously degrading the antenna impedance. This is an important requirement since the efficiency of the antenna is maintained as the system adapts to filter out the interference via the influence the variable loads have on X. This does not preclude the possibility of designing the parasitics with somewhat stronger coupling. The latter would be important to a multifunctional CPA for which tunability would be the most desirable feature of the system.

The features described in the previous paragraphs provide significant advantages to adaptive antenna systems that make use of CPA concepts. These include:

1. A CPA can be designed to have adaptable pattern control with only a single antenna output port. This greatly simplifies the electronics of a CPA in comparison to what is required with conventional "smart antenna" systems.
2. A CPA can be designed to have significant pattern control within a much smaller aperture than what is required for an adaptive phased array system. This aperture can be less than a one-half wavelength across.
3. Since the adaptability of a CPA is in the RF front end, it can provide signal control over a larger dynamic range than can be handled with "smart antenna" concepts.
4. The use of parasitics can allow for considerable pattern control without significantly degrading the tuning of the antenna element or elements.
5. Since the adaptability of a CPA is in the RF front end, the parasitics and the variable loads can also be designed to provide adaptable (closed loop) or switchable (open loop) tuning for the antenna. This means that a CPA could be designed to operate over a considerable range of frequency bands. This would provide considerable multifunctional capability within a single small aperture.

DETAILED DESCRIPTION OF A PARTICULAR EMBODIMENT OF THE INVENTION

Referring now to the drawings, which are intended to illustrate a presently preferred exemplary embodiment of the invention only and not for the purpose of limiting same, a basic block diagram of a CPA (controlled parasitic antenna) system is shown in FIG. 7. This drawing shows the antenna reference plane R (71), which could consist of one or more ports. The RF signal from R passes into a receiver feed network (78) and then to the receiver unit (77). Actually the latter could just as well be a transceiver, however, the emphasis in this description is on the adaptive nature of the CPA. This adaptability would be based on the receive mode of the system. The receiver unit passes the signal to some type of output device. A specific metric of the signal received at R is also passed to the adaptive logic/voltage control unit (74), which is part of the feedback and control loop. The feedback to the logic unit could occur pre-receiver (72) or post-receiver (73). Systems using both pre and post feedback are also envisioned. For pre-receiver feedback a power splitter would be placed in the receiver feed network to divert some of the signal to the feedback loop. Typically, this diverted signal would be conditioned in some manner such as with filters and down converters. Also, a low noise amplifier LNA may be placed before the splitter so that the diversion of some of the power does not adversely affect the noise figure of the system. In pre feedback the metric would typically be a measure of the power received in some frequency band. This could also be true for post feedback but the latter also allows many other possibilities—particularly in digital systems for which this metric could be directly related to the quality of the desired signal. The adaptive logic/voltage control unit (74) receives metric values at some frequency $F_m$ and updates the settings of the control signals (75) at some frequency $F_c$. These control signals are the bias settings for each of the active control devices (76) in the control network (see (42) in FIG. 4). The control network impedance matrix (represented as $S^C$ in FIG. 6) is a function of these biases. The physical properties of the total signal received at R are dependent on this control network impedance. A control algorithm is implemented in the logic/voltage control unit (74). The purpose of this algorithm is to cause the metric or metrics to converge to a maximum, or a minimum, or a pre-determined value. It does this by updating the control signal settings at the rate F. The algorithm computes each such update by making use of the recent history of both metric values and bias settings. The algorithm may also include a set of precalibrated, fixed parameters that depend on the specific antenna structure and feed system in use.

One attribute of the invention is an antenna system that includes an active control feedback loop which regularly updates the control settings of active RF load circuits that are attached to parasitic elements in the antenna aperture. The purpose of the control feedback loop is to adapt the impedances of the parasitic elements in the antenna aperture so as to produce a front-end RF control of the received signals. The primary purpose for the use of parasitic elements is that this type of design allows the antenna to be resilient to detuning while at the same time it enables a considerable amount of RF front-end control of signals.

Figure 8:
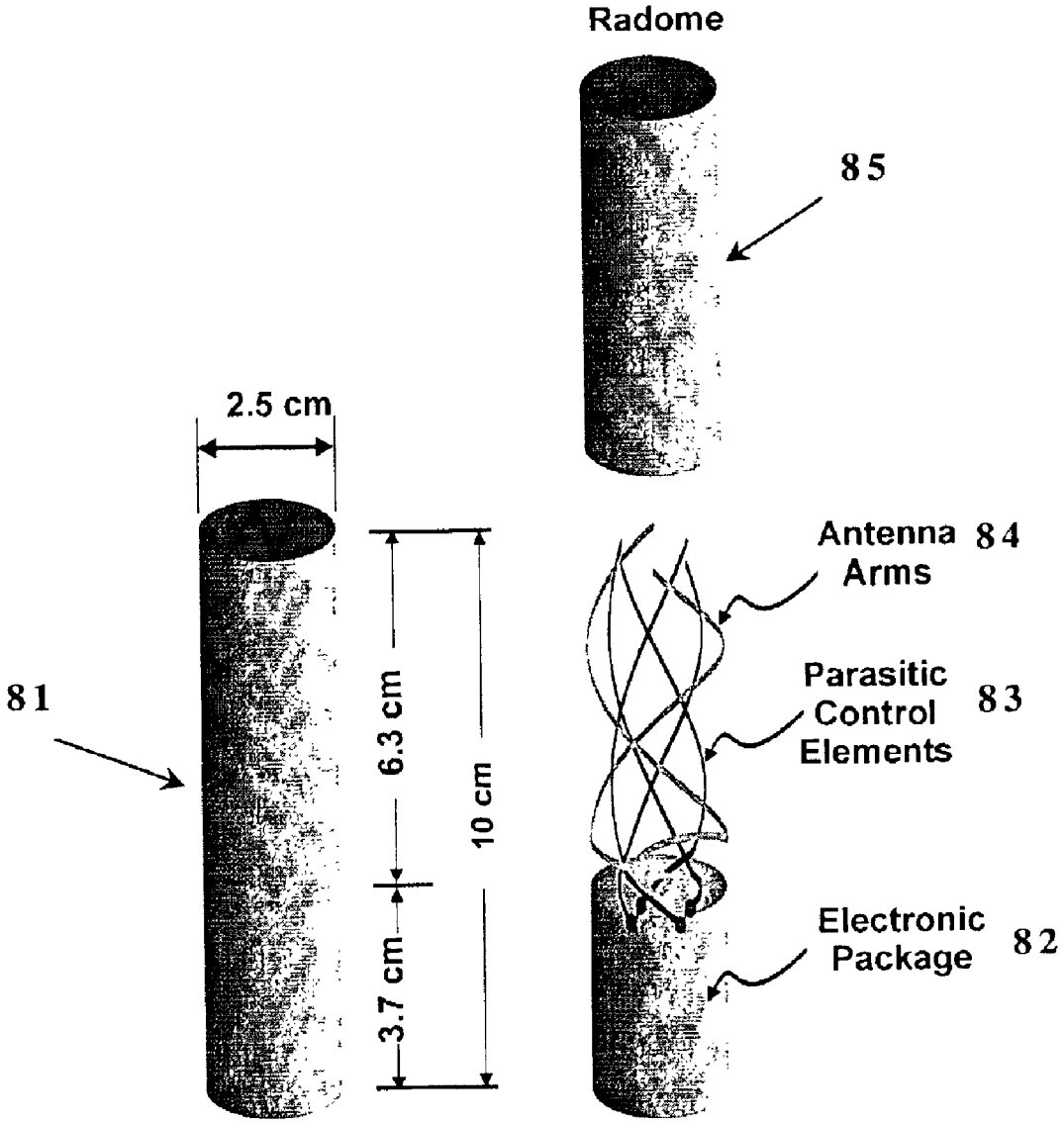
FIG. 8 depicts a particular CPA design, which is one example of the CPA invention. The application in this case is that of an antijam GPS antenna

FIG. 8 shows a drawing of a particular CPA design. This design is one example of the CPA invention. The application in this case is that of a GPS antenna that can counter the jamming of the GPS signals. Furthermore, it is desired to have this antenna fit into the current antenna form factor (81) of a specific hand held GPS unit. The overall length (10 cm) of the antenna system is about 0.5 wavelengths at the upper (L1) GPS frequency. The capability of providing adaptable functionality in an existing form factor is an important feature of the CPA concept. This means that an adaptable antenna can directly replace a current fixed antenna without changing the space allocated for the antenna. In most situations the introduction of a phased array "smart antenna"

design would require a substantial increase in aperture size. FIG. 8 illustrates three basic parts of this antenna system. The electronic package (82) houses the feeds, the feed back loop electronics and the control devices. There are four helical parasitic control elements (83). Each of these has a control device attached at its base. The position where each parasitic element attaches to its corresponding control device is a control port. The parasitic helices are mounted on a single tube with very thin semi-flexible dielectric walls. There are two active antenna arms (84) that are connected directly to the feed ports. The combiner in the feed enables these arms to be fed at 180 degrees relative phase. These antenna arms are also helices and mounted on the same type of dielectric tube as the parasitic elements. The helical radius of the antenna arms is 20 to 25 per cent larger than the parasitic element helical radius. This is done so as to provide the appropriate level of coupling between the feed ports and the control ports. It is particularly important to note that the parasitics are contained within the aperture of the radiating element. The use of helices fed in this way gives this antenna a predominantly RHCP polarization. This is very advantageous for the reception of the GPS signals. A radome (85) made of standard radome material fits over the antenna structure. Within geometrical constraints the helical parameters of both the active antenna arms and the parasitic elements were optimally chosen. This optimization also took into account the material properties of the dielectric supports and the radome. This optimization had two basic goals. The first was to provide a well-tuned element at the L1 and L2 GPS bands. The other was to provide a semi-weak coupling between the common port (41 in FIG. 4) and the control ports (43 in FIG. 4). Semi-weak means that the S-parameter coupling (the S12 parameters) between the R and C ports is strong enough to provide significant pattern control but weak enough so that the variation of the control impedances cannot detune the antenna at the operational bands. The pattern is affected to first order in this coupling but the antenna impedance is affected to second order. Ideally, the S12 magnitudes should be in the approximate range of 0.2 to 0.3.

Figure 9:
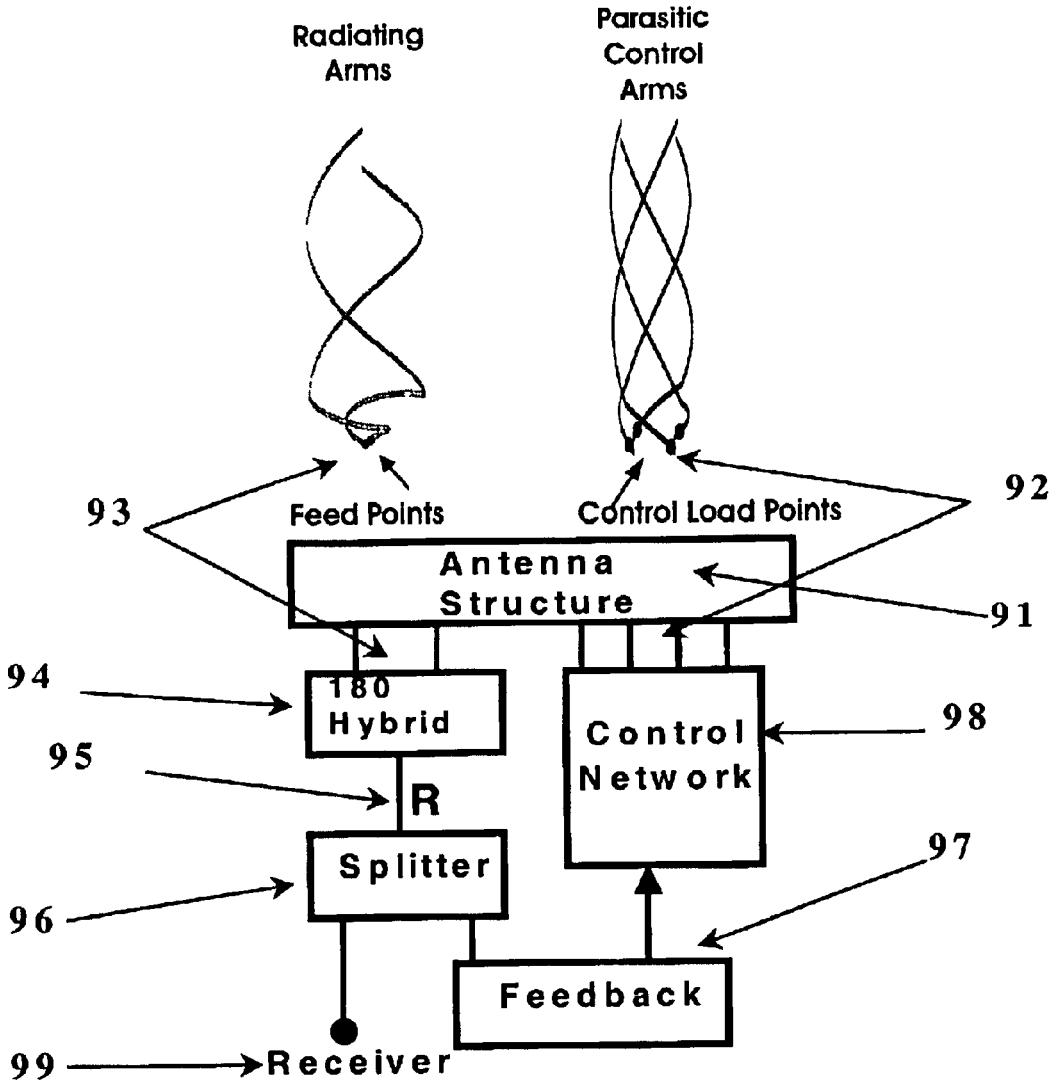
FIG. 9 depicts a block diagram of the antijam CPA system.

FIG. 9 illustrates this design as a block diagram that can be compared to both FIGS. 4 and 7. For this particular embodiment the antenna structure (91) is a 6-port network that quantifies all the RF interactions of the antenna arms, parasitics, dielectric and the radiation zone. For this system there are four control load points or ports (92) and two feed ports (93). A 180-degree IC hybrid (94) forms the RF feed (95 in FIG. 4). A single R port (95) is common to both active arms. A splitter (96) diverts some of the R port signal to the feedback loop. The rest of the signal power goes directly to the receiver. This particular embodiment of the invention is a pre-receiver feedback design. The feedback system (97) sends bias signals to the active devices in the control network (98) to affect the impedance of that network. The metric used by the feedback algorithm is the power that the feedback system receives in the L1 and/or the L2 bands. The algorithm continually adjusts the bias settings so as to minimize this power or maintain the power near or at the system noise level. Since the antenna is designed to maintain its tuning, this power minimization corresponds to the adjustment of the polarization properties of the antenna so as to filter out the strongest interfering signals. The satellite signals can still reach the receiver (99) with only minor attenuation.

Figure 10:
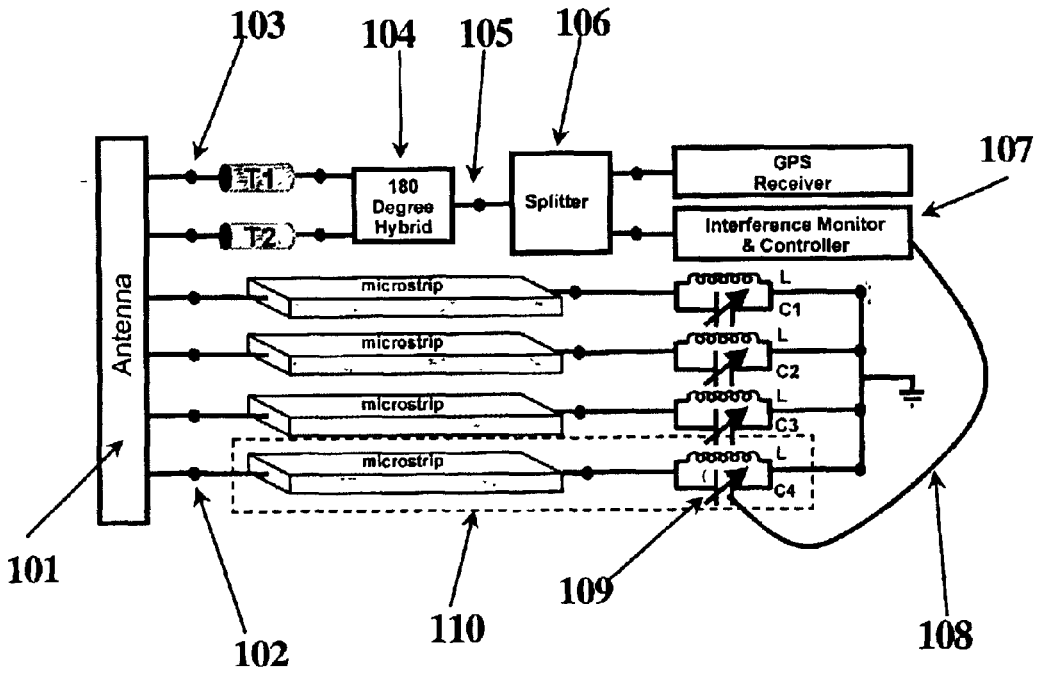
FIG. 10 depicts another illustration of this design that particularly emphasizes the circuitry of the control load network.
Figure 11:
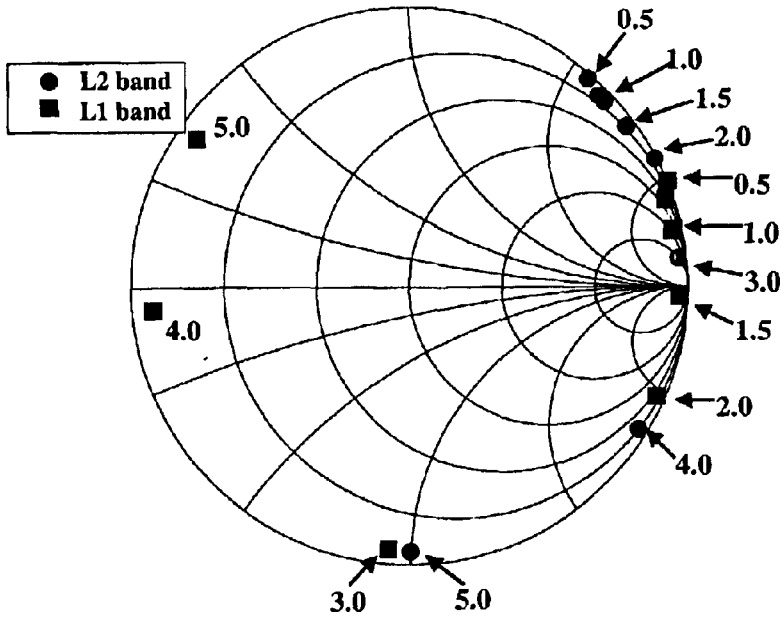
FIG. 11 depicts the range of the FIG. 8 load circuit impedances at the L1 and L2 GPS bands as the varactor is varied from 0.5 pF to 5.0 pF. Different points on the Smith Chart are labeled by the corresponding varactor capacitances (pF).

FIG. 10 provides another illustration of this design. This figure particularly emphasizes the circuitry of the control load network. Again the antenna structure appears as a 6-port network. The feed ports (103) connect to the hybrid (104) via some connectors, which are represented as short transmission line segments. The common port (105) is followed by the splitter network (106). Some of the signal power is diverted to the feedback system (107). A bias line goes to each active device. One of those lines (108) is illustrated in the drawing. In this particular embodiment of the invention the active device is a variable capacitor (109). This device is modeled as a capacitance and inductance in parallel. In the figure each of the four load circuits is modeled as a transmission line segment terminated by the variable capacitor. One of these circuits is outlined (110). The parameters of these load circuits are optimized to provide as much a range of reactive impedance as possible at both the L1 and L2 bands. For the case shown a varactor was chosen with capacitance values ranging from 0.5 pF to 5.0 pF. Other load circuits are possible. The invention does not require particular choice of load circuit. The purpose of the circuit is simply to provide an impedance that can be controlled over a significant portion of the Smith Chart. FIG. 11 shows the range of impedance values at the L1 and L2 GPS frequencies as the varactor is varied over its range of capacitances. At L1 the impedance points for each capacitance value (pF) are shown as squares and at L2 the corresponding impedance points are indicated as circles. The circuit shown can be readily implemented using monolithic fabrication techniques. The microstrip line length could be optimized to get the best range of impedance for the application. This would take into account packaging constraints as well as the limits on varying the properties of the active device (varactor in this embodiment) used. In some situations it may be desirable for practical reasons to fix this line length to be as short as possible when fabricating the circuit.

Figure 12:
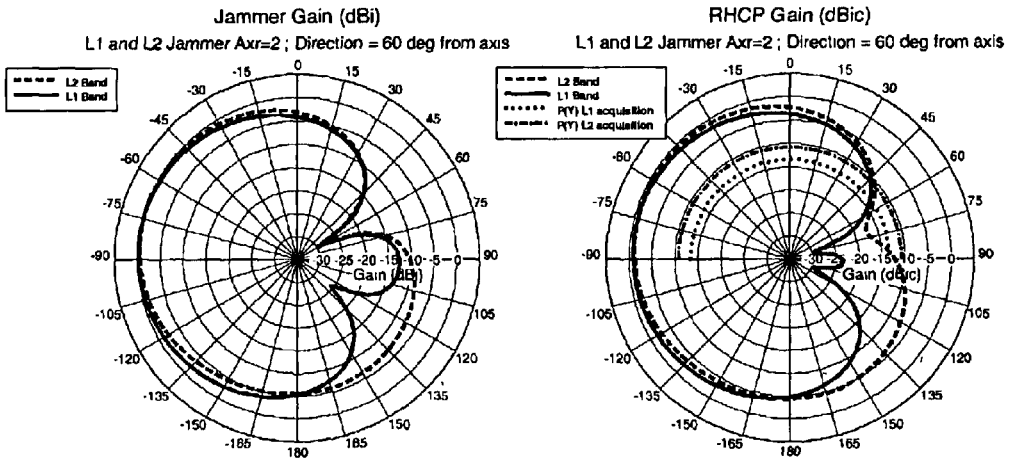
FIG. 12 depicts the antenna patterns of the FIG. 6 system after adapting to a nearly RHCP jammer (axial ratio of 2) at 60 degrees with power in both the L1 and L2 GPS bands.

FIGS. 12 and 13 illustrate different but similar jamming situations. These are particular results for the system depicted in FIGS. 8 and 10. The purpose of showing this data is to illustrate both the adaptive nature of this antenna system as well as its resilience to detuning. The control loads were allowed to vary to null the jammer gain. On the left side of each figure is the pattern gain of the jammer's polarization. On the right side is shown the corresponding GPS (RHCP) gain. Also shown are the gain thresholds for L1 and L2 acquisition and tracking. In FIG. 12 the jammer was placed at 60 degrees from the antenna axis which points at 0 degrees in the figures. The polarization of the jammer was almost RHCP (axial ratio of 2) and was jamming both the L1 and L2 bands simultaneously. This would be considered a particularly demanding jamming threat. A pattern null in the direction and polarization of the jammer can be seen for both the L1 and L2 bands. The RHCP coverage remains adequate over much of the upper hemisphere, which presumably would correspond to the sky directions. The situation in FIG. 13 is similar to that of FIG. 12. The only difference is that the jammer power is restricted to the L1 band only. Similar comments to those of FIG. 12 apply.

What is claimed is:

1. A controlled parasitic antenna system having loaded parasitic elements within a radiating aperture of a small antenna element and having a largest dimension of about one-half wavelength at the lowest frequency of its operational band, said system comprising:

a. active controller circuits embedded either in the aperture of the antenna element or behind the ground plane of said element, said active controller circuits having impedance characteristics that can be varied by changing the values of electrical control signals applied to active components within the circuits;

b. said parasitic elements being contained within the radiating aperture of the antenna element and being electrically connected to said active controller circuits; and c. an active feedback control loop which regularly updates control settings of said active controller circuits attached to said parasitic elements in the antenna aperture.

2. The antenna system of claim 1, wherein the feedback control loop adapts biases applied to the active controller circuits and, thereby, adapts impedance characteristics of the parasitic elements in the antenna aperture so as to produce a front-end RF control of received signals.

3. A controlled parasitic antenna system having loaded parasitic elements within a radiating aperture of a small antenna element and having a largest dimension of about one-half wavelength at the lowest frequency of its operational band, said system comprising:

a. active control circuits embedded either in the aperture of the antenna element or behind the ground plane of said element, said active control circuits having impedance characteristics that can be varied by changing the values of electrical control signals applied to active components within the circuits;

b. said parasitic elements being contained within the radiating aperture of the antenna element and being electrically connected to said active control circuits; and c. an active feedback control loop which regularly updates control settings of said active control circuits attached to said parasitic elements in the antenna aperture;

wherein the feedback control loop adapts biases applied to the control circuits and, thereby, adapts impedance characteristics of the parasitic elements in the antenna aperture so as to produce a front-end RF control of received signals; and wherein said feedback loop comprises a logic unit and a voltage control unit.

4. The antenna system of claim 3, wherein said logic unit receives at its input feedback at regular intervals, applies a control algorithm to said feedback, and outputs at regular intervals to the voltage control unit updated estimates of bias setting values as determined by said control algorithm.

5. The antenna system of claim 4, where said feedback comprises a sequence at regular intervals of metric values that are determined directly from combination of all received waveforms entering through an antenna feed port or ports.

6. The antenna system of claim 3, wherein said voltage control unit receives at its input at regular intervals a sequence of bias estimate values and uses these to set updated voltage biases that are applied to the active components in the control circuits.

7. The antenna system of claim 1, wherein the parasitic elements allow the antenna system to be resilient to detuning while at the same time enabling a considerable amount of RF front-end control of signals via adaptation of impedance characteristics of the active controller circuits.

8. The antenna system of claim 5, further comprising a power distribution system between input and feed ports.

9. The system of claim 8, wherein the feedback can be either pre-receiver, post-receiver, or both.

10. The antenna system of claim 9, wherein pre-receiver feedback is accomplished at RF by including a splitter in the RF power distribution network prior to the input port.

11. The antenna system of claim 9, wherein post-receiver feedback is accomplished by computing a signal metric and directing that metric value at some regular interval to the logic unit.

12. The antenna system of claim 4, wherein the purpose of said algorithm is to cause the metric or metrics to seek a maximum, or a minimum, or a predetermined value or values.

13. The antenna system of claim 12, wherein the maximum, minimum and predetermined value are obtained by computing updated bias estimates at regular intervals, which updated estimates are received by the voltage control unit.

14. The antenna system of claim 13, wherein said updated estimates are computed by making use of the recent history of both metric values and bias settings.

15. The antenna system of claim 4, wherein said algorithm includes a set of pre-calibrated, fixed parameters that depend on the specific antenna structure and feed system in use.

16. A method of controlling a parasitic antenna system having loaded parasitic elements within a radiating aperture of a small antenna element, having a largest dimension of about one-half wavelength at the lowest frequency of its operational band, and having the loaded parasitic elements being electrically connected to active controller circuits, said method comprising:

changing the value of electrical control signals applied to active components within the active controller circuits; and using a feedback control loop to regularly update control settings of the active controller circuits.

17. The method of claim 16, wherein the feedback control loop adapts biases applied to the active controller circuits and, thereby, adapts impedance characteristics of the parasitic elements in the antenna aperture so as to produce a front-end RF control of received signals.

18. A method of controlling a parasitic antenna system having loaded parasitic elements within a radiating aperture of a small antenna element, having a largest dimension of about one-half wavelength at the lowest frequency of its operational band, and having the loaded parasitic elements being electrically connected to active control circuits, said method comprising:

changing the value of electrical control signals applied to active components within the active control circuits; and using a feedback control loop to regularly undate control settings of the active control circuits;

wherein the feedback control loon adapts biases applied to the control circuits and, thereby, adants impedance characteristics of the parasitic elements in the antenna aperture so as to produce a front-end RF control of received signals; and wherein a logic unit receives at its input feedback at regular intervals, applies a control algorithm to said feedback, and outputs at regular intervals to a voltage control unit updated estimates of bias setting values as determined by said control algorithm.

19. The method of claim 18, where said feedback comprises a sequence at regular intervals of metric values that are determined directly from combination of all received waveforms entering through an antenna feed port or ports.

20. The method of claim 18, wherein the voltage control unit receives at its input at regular intervals a sequence of bias estimate values and uses these to set updated voltage biases that are applied to the active components in the control circuits.

21. The method of claim 16, wherein the parasitic elements allow the antenna system to be resilient to detuning while at the same time enabling a considerable amount of RF front-end control of signals via adaptation of impedance characteristics of the active controller circuits.

22. The method of claim 19, wherein the feedback can be either pre-receiver, post-receiver, or both.

23. The method of claim 22, wherein pre-receiver feedback is accomplished at RF by diverting some of a received signal to the feedback control loop.

24. The method of claim 22, wherein post-receiver feedback is accomplished by computing a signal metric and directing that metric value at some regular interval to the logic unit.

25. The method of claim 18, wherein the purpose of said algorithm is to cause the metric or metrics to seek a maximum, or a minimum, or a pre-determined value or values.

26. The method of claim 25, wherein the maximum, minimum and predetermined value are obtained by computing updated bias estimates at regular intervals, which updated estimates are received by a voltage control unit in the feedback control loop.

27. The antenna system of claim 26, wherein said updated estimates are computed by making use of the recent history of both metric values and bias settings.

28. The method of claim 18, wherein said algorithm includes a set of pre-calibrated, fixed parameters that depend on the specific antenna structure and feed system in use.

* * * * *